US007320483B2

(12) United States Patent
Eippert

(10) Patent No.: US 7,320,483 B2
(45) Date of Patent: Jan. 22, 2008

(54) MEDICATION REMINDER SYSTEM

(76) Inventor: Greg Eippert, 8080 Hackberry Dr., Mentor, OH (US) 44060

( * ) Notice: Subject to any disclaimer, the term of this patent is extended or adjusted under 35 U.S.C. 154(b) by 270 days.

(21) Appl. No.: 09/920,386

(22) Filed: Aug. 1, 2001

(65) Prior Publication Data

US 2002/0041091 A1 Apr. 11, 2002

Related U.S. Application Data

(60) Provisional application No. 60/222,242, filed on Aug. 1, 2000.

(51) Int. Cl.
*B42D 15/00* (2006.01)

(52) U.S. Cl. ..... 283/67; 206/534; 283/81; 283/101; 283/114; 283/115; 283/900

(58) Field of Classification Search ..... 283/2–3, 283/36, 114–115, 32, 56, 65, 66.1, 81, 900, 283/67, 100, 101; 235/60.41, 63 R, 65, 66, 235/91 D, 110; 229/74; 368/222; 434/238, 434/430; 40/904; 206/534, 459.1
See application file for complete search history.

(56) References Cited

U.S. PATENT DOCUMENTS 1,073,364 A * 9/1913 Rush ..... 283/55
3,596,388 A * 8/1971 Shorten ..... 283/55
3,841,260 A * 10/1974 Sharp et al. ..... 116/325
4,148,273 A * 4/1979 Hollingsworth et al. .... 116/325
4,295,664 A * 10/1981 Cutting ..... 283/115
4,346,697 A * 8/1982 Cohen ..... 283/115
4,639,226 A * 1/1987 Rahn et al. ..... 434/433
4,815,767 A * 3/1989 Lambert ..... 283/67
5,031,488 A * 7/1991 Zumeta ..... 81/180.1
5,056,826 A * 10/1991 Suwa ..... 283/67
5,102,169 A * 4/1992 Mayfield ..... 283/115
5,261,702 A * 11/1993 Mayfield ..... 283/115
5,431,450 A * 7/1995 Coleman ..... 283/115
5,447,336 A * 9/1995 Deighton ..... 283/115
5,758,096 A * 5/1998 Barsky et al. ..... 705/3
5,810,395 A * 9/1998 Morgan ..... 283/70
5,882,041 A * 3/1999 Schara ..... 283/66.1
5,992,888 A * 11/1999 North et al. ..... 283/56
5,995,938 A * 11/1999 Whaley ..... 705/3
6,349,315 B1 * 2/2002 Sonoyama et al. ..... 715/528
6,828,968 B1 * 12/2004 Tenorio ..... 345/440

* cited by examiner

*Primary Examiner*—Daniel W. Howell

(57) ABSTRACT

A medication reminder system is provided for allowing patients, especially those with memory or eyesight problems, to improve compliance with a medication regimen that has been prescribed by their physician. The system is organized for ease of patient identification by recording medications in blank or color-coded fields upon a sheet to match an indicator associated with a medication container. The sheet also includes markings associated with some or all of the medications which provide a way for the patient to gain more information about the medication.

17 Claims, 2 Drawing Sheets

MEDICATION REMINDER SYSTEM

PRIORITY CLAIM

This application claims the benefit of U.S. provisional patent application number 60/222,242 filed on Aug. 1, 2000, the entirety of which is hereby incorporated by reference

FIELD OF THE INVENTION

This invention generally relates to a medication reminder system and more specifically to a system of linking drug dosage information to drug storage containers.

BACKGROUND OF THE INVENTION

Modern medicine has made great strides in providing remedies for many common and serious afflictions. An effective and preferred method of treatment, in many cases, is administration of drugs. Consequently, many patients are required to take one or more drugs for either a short treatment period or for extended periods of time.

It can be confusing to remember the treatment parameters of each drug and which container of drugs corresponds to what treatment regimen. This problem is accentuated when the patient suffers from an ocular disorder, and/or short term memory difficulties, as may be the case with older patients. Reading small text on drug containers or even determining what kind of drug is within a specified container can be difficult. Also, it can be difficult for a patient to learn more about the drugs they are taking. Information such as dosage limits and interaction effects with other drugs may be important.

Information relevant to attempts to address these problems can be found in U.S. Pat. No. 5,031,937. However, this reference suffers from the disadvantage that it does not disclose a system of linking drug containers to regimen information sheets which is easily used by the visually impaired. Further, this reference does not disclose an easy way for the user to obtain more information about the drugs being taken or prescribed.

SUMMARY OF THE INVENTION

The present invention is directed to an information system that satisfies these needs. The system comprises a color coded sheet depicting one or more rows and one or more columns. These rows and columns form a matrix which defines a plurality of fields. The rows and columns further include headers which define parameters of each row or column. These parameters include: medication, where to administer medication, when to administer medication and comments on administering medication. The system further comprises one or more color coded containers, the container color corresponding to the colors on the coded sheet.

An individual patients prescription information is added to a sheet manually or via a computer. Using a printer, a completed coded sheet can be printed from the computer. Prescription information within the computer can be also transferred electronically to a patient's home or to a pharmacist.

The system may have a color coded sheet used in any number of medical fields, or to an individual field, particularly Ophthalmology in the present application. The system may have a color coded sheet specifically having rows shaded different colors. The system overcomes the problem of linking drug containers to regimen information sheets in a way which is easily used by patients to increase the understanding of their medical regimen.

DETAILED DESCRIPTION OF PREFERRED AND ALTERNATE EMBODIMENTS

Figure 1:
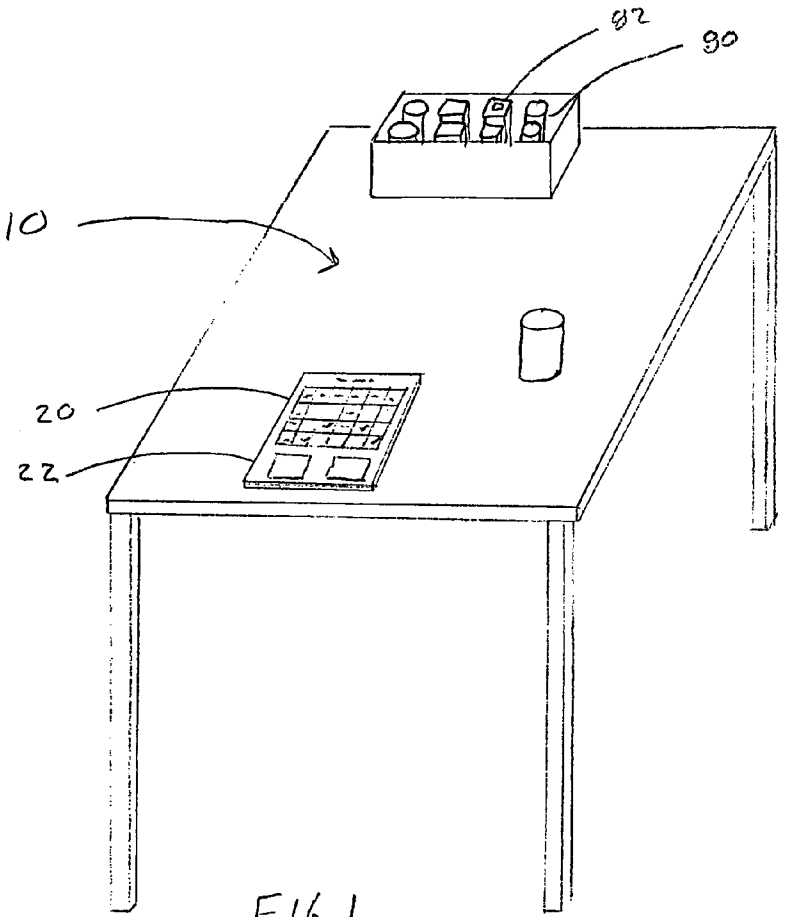
FIG. 1 shows a schematic of the medication reminder system.

As shown in FIG. 1, a medication reminder system 10 comprises a color coded sheet 20 and one or more color coded containers 80 for holding medications. The color coded sheet 20 may be designed for a group of specific medical afflictions (e.g. an Ophthalmology version) or may be generalized.

The color coded sheet 20 may be one part of a larger tablet 22 which holds multiple sheets 20. The sheet 20 is preferably made of paper, but may be other materials such as plastic or cardboard. The sheet 20 functions to store information about what medication a patient should take, how to take the medication and when to take the medication. The sheet 20 may also be used by caregivers who administer medications to patients.

Figure 2:
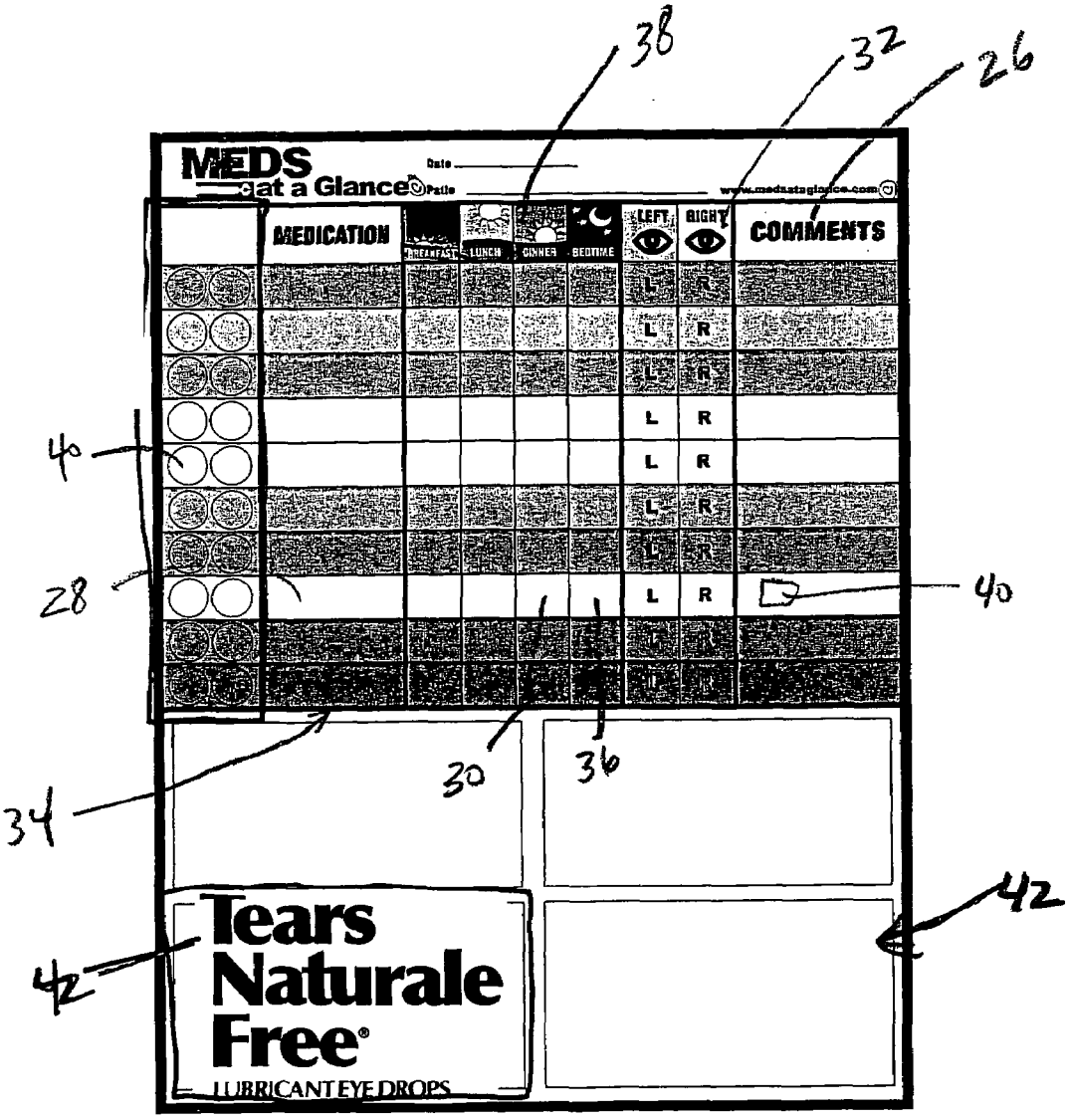
FIG. 2 shows a sheet containing information.

Referring to FIG. 2, information is recorded on the color coded sheet 20. The sheet 20 includes one or more rows 28 and one or more columns 30. The rows 28 and columns 30 intersect to form a matrix 34. The matrix defines individual fields 36. Each row 28 and column 30 includes a header 38. Markings 26 which can include icons 32 can be placed within the header 38 which define a parameter associated with the row 28 or column 30. Each field 36, which is created by an intersecting row 28 and column 30, necessarily has two defining parameters; a parameter from its row header 38 and a parameter from its column header 38.

The sheet 20 may be color coded by shading an entire row 28 or column 30 with a color. An adjacent row 28 or column 30 may be shaded with a different color. Alternatively, a field 36 within each row 28 or column 30 may be designated for color identification. A colored sticker 40 may be placed in this field 36 to depict the color of the row 28 or column 30. A sheet 20 may include one or more rows 28 or columns 30 which are not color coded in any way. Additional markings 26 may be placed directly within individual fields 36.

The color coded sheet 20 includes medical markings 26 on its surface. These markings 26 include designations of which medications are to be taken. The markings 26 also include designations of what time(s) the medications should be taken, for example breakfast, lunch, dinner, or bedtime. The markings 26 also include where the medications should be applied or ingested, for example in the case of ocular medication, in the left eye, right eye, or both. The markings 26 may also include advertisements 42 or coupons for specific brand name drugs. These advertising or coupon markings are located outside of the matrix 34. The advertisements 42 correspond to entries on a medical information database stored on a website supplied by the sponsoring advertiser of the sheet 20. The advertisement markings 26 may be changed on subsequent printings of the sheet 20.

Markings 26 and/or icons 32 may also be placed within individual fields 36. For example, a field 36 created by a column 30 having a header stating "Lunch" and a row 28 having a header 38 stating "Medicine A" may be filled with a check mark icon 32. This icon 32 indicates that Medicine A should be taken at lunch. Alternatively, a field 36 created by a column 30 having a header 38 stating "Comments" and a row 28 having a header 38 stating "Medicine B" may be filled with text markings 26, such as "take only on an empty stomach."

Referring again to FIG. 1, the system 10 also contains one or more containers 80 to hold medicine. The containers 80 may be any shape or size such as bottles for solid medicine, and bottles, droppers and vials for liquid medicine. The containers 80 may be made from any material such as glass, plastic, or metal. The containers 80 also contain indicators 82. Indicators 82 may be such things as, colored caps, colored stickers, or colored text or the color of the medication itself. The containers 80 function to store medicine. The containers 80 further function, using their indicators 82, to allow easy identification of the medicine contained within. The containers 80 cooperate with the color coded sheet 20 in that each colored indicator 82 upon a container 80 matches a colored section of the sheet 20.

To make use of the present system, the sheet 20 must be first filled out according to a doctor's prescription instructions. The sheet 20 may be filled out by the patient, doctor or a pharmacist. The appropriate fields 36 are completed with markings 26 and/or icons 32. In one embodiment of the invention the markings 26 are manually written onto a pre-printed sheet 20 by a doctor or doctor's assistant. In another embodiment of the invention the prescription instructions or information is inputted into a computer system. A printer within the computer system then prints markings onto a preprinted sheet or prints the markings as well as the rows, columns and headings onto a blank sheet. The completed sheet is then given to the patient or his or her caregiver. In addition, or alternatively, the computer system can send relevant prescription instructions or information, via electronic means known in the art, to a patient's home or to a pharmacy. Any information can be transmitted to the pharmacy, but especially relevant information includes drug refill authorizations and new medication prescription information.

If the patient has not already picked the specific medication or brand or desires information on side effects and interactions, he may refer to the markings regarding advertisements 42. The patient or pharmacist may access a website where information about drugs matching the markings 42 are kept, or minimal information can be provided at the location of the marking 42. Medicine containers 80 are then color coded according to the prescription instructions and colors on the sheet 20. The patient refers to the sheet 20 one or more times a day to determine when and how dosages of medicine must be taken. The patient uses the color coding system to easily identify the correct medicine container.

The present medication reminder system 10 has common color coding existing between the information sheet 20 and the medicine containers 80. Patients, especially those being treated for a disorder of the eyes can easily match the appropriate dosage instructions with the appropriate medicine. The system also provides easy access to more information about the medications prescribed. A patient simply refers to a marking regarding advertisements 42 on the information sheet 20 and accesses a website having a database including all such medications.

Although the invention has been shown and described with reference to certain preferred embodiments, the invention is not limited to these specific embodiments. Minor variation and insubstantial differences in the various combination of material and methods may occur to those of ordinary skill in the art while remaining within the scope of the invention as claimed and equivalents.

The invention claimed is:

1. A system for reminding patients or caregivers what medication to take or administer, how to take and administer the medication, and when to take or administer the medication comprising:

a color-coded sheet;

said sheet depicting one or more rows, wherein one or more of said rows are completely color shaded, and one or more columns, said rows and columns intersecting to form a matrix, said matrix comprising a plurality of fields;

said rows and columns further including headers, said headers defining parameters of said row or column and of said fields;

said headers including medical markings; and one or more color coded medication containers.

2. The system of claim 1 wherein said rows are fully shaded in different colors.

3. The system of claim 1 wherein said medical markings include indicators of medications.

4. The system of claim 3 wherein said medications relate to ophthalmology.

5. The system of claim 4 wherein one of said markings designate which eye to place medication within.

6. The system of claim 3 wherein said color coded sheet further includes one or more advertising markings and one or more of said advertising markings correspond to one of said indicators of medications.

7. The system of claim 1 wherein said color coded sheet further includes one or more areas for placing advertising markings.

8. The system of claim 1 wherein said markings include icons and at least one of said icons is a graphic representation of a time period within a day.

9. The system of claim 1 wherein said markings include indicators of medication, where to administer said medication, when to administer said medication and comments on administering said medication.

10. A method of reminding a patient or caregiver when to take or administer medication comprising the steps of:

a) placing information upon color coded sheets having fully shaded color coded rows, b) applying colored indicating devices to one or more containers of medication.

11. The system of claim 1 wherein said one or more color coded containers includes a color coded cap corresponding to the color of said completely color shaded row.

12. The system of claim 1 wherein each of said one or more completely color shaded rows includes a field in which a sticker depicting the color shade of that row may be placed.

13. The system of claim 12 further including a sticker within said field in each of said one or more rows.

14. The system of claim 3 further including one or more coupons within said color-coded sheet wherein one or more of said coupons correspond to one of said indicators of medications.

15. A system for reminding patients or caregivers what medication to take or administer, how to take and administer the medication, and when to take or administer the medication comprising:

a tablet of multiple sheets of color-coded paper;

each sheet depicting one or more rows wherein said rows are entirely color shaded and one or more columns, said rows and columns intersecting to form a matrix, said matrix comprising a plurality of fields;

said rows and columns further including headers, said headers defining parameters of said row or column and of said fields;

said headers including medical markings; and one or more color coded medication containers.

16. The system of claim 3 wherein said color coded sheet further includes on or more areas for placing advertising markings.

17. The system of claim 3 wherein said color coded sheet further includes one or more advertising markings and one or more of said advertising markings correspond to a pharmacy where said sheet may be used.

* * * * *